US006679451B1

(12) United States Patent
Biagiotti

(10) Patent No.: US 6,679,451 B1
(45) Date of Patent: Jan. 20, 2004

(54) DEVICE AND METHOD FOR UNWINDING REELS OF WEB MATERIAL

(75) Inventor: Guglielmo Biagiotti, Capannori (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 09/937,037

(22) PCT Filed: Mar. 20, 2000

(86) PCT No.: PCT/IT00/00091

§ 371 (c)(1),
(2), (4) Date: Oct. 18, 2001

(87) PCT Pub. No.: WO00/56644

PCT Pub. Date: Sep. 28, 2000

(30) Foreign Application Priority Data

Mar. 22, 1999 (IT) ..... FI99A0057

(51) Int. Cl.[7] ..... B65H 16/06; B65H 16/10; B65H 19/12

(52) U.S. Cl. ..... 242/559; 242/559.1; 242/559.3; 242/559.4; 242/564.5

(58) Field of Search ..... 242/559, 559.1, 242/559.3, 559.4, 564.5

(56) References Cited

U.S. PATENT DOCUMENTS

| | | | | |
|---|---|---|---|---|
| 1,949,238 A | * | 2/1934 | Broadmeyer | 242/564.5 |
| 1,967,056 A | | 7/1934 | Horton | |
| 2,984,426 A | | 5/1961 | Johnson | |
| 3,478,974 A | * | 11/1969 | Roscoe et al. | 242/564.5 |
| 3,740,296 A | | 6/1973 | McDonald | |
| 4,162,025 A | * | 7/1979 | Achelpohl et al. | 242/564.5 |
| 4,392,912 A | * | 7/1983 | Horsley | 242/559.3 |
| 5,330,126 A | * | 7/1994 | Grischenko | 242/559 |
| 5,730,389 A | | 3/1998 | Biagiotti | |
| 6,213,423 B1 | * | 4/2001 | St. Germain et al. | 242/559.1 |

FOREIGN PATENT DOCUMENTS

| | | |
|---|---|---|
| DE | 445 034 | 5/1927 |
| EP | 0 321 887 A2 A3 | 6/1989 |
| WO | WO 96/33120 A1 | 10/1996 |

* cited by examiner

*Primary Examiner*—John M. Jillions
(74) *Attorney, Agent, or Firm*—Breiner & Breiner, L.L.C.

(57) ABSTRACT

The device comprises in combination: a carriage (1) movable in a direction of displacement between a loading and unloading position and an unwinding position; on said carriage, at least one oscillating arm (25) for supporting at least one reel (B) of web material, and at least one actuator (39) for moving said oscillating arm; in the unwinding position, a flexible unwinding member (45) driven around a plurality of pulleys (47, 49, 51, 53), at least one of which is motorized, a member (61) for tensioning the flexible unwinding member being associated with at least one (47) of said pulleys.

18 Claims, 6 Drawing Sheets

DEVICE AND METHOD FOR UNWINDING REELS OF WEB MATERIAL

DESCRIPTION

1. Technical Field

The present invention relates to an unwinding device for unwinding a reel of web material, in particular a large-diameter reel for supplying web material to a processing machine located downstream of the unwinder.

Devices of this kind are used, for example, in the paper converting industry in order to supply one or more plies of paper to a rewinding machine which produces a plurality of rolls with a relatively small diameter (corresponding to the diameter of the finished rolls intended for the final user) from large-diameter reels supplied by the paper mill.

Similar unwinding devices are used in all those situations where it is required to unwind web material from a reel in order to perform various kinds of processing operations thereon.

2. State of the Art

International application WO-A-9633120 discloses an unwinder for large-diameter reels of web material, in which the reel is supported by a central spindle arranged on a carriage movable in the direction of the axis of said reel. The carriage supports two spindles so as to be able to have one reel in the working position supported by a first of the two spindles and unload the empty tubular core from the second of the two spindles and replace it with a new reel in a loading and unloading position. The two spindles supported by the carriage are in a fixed position with respect to said carriage. Unwinding of the reel is obtained by means of a series of belts driven around a plurality of pulleys, one of which is motorized and which are mounted on an oscillating arm which is brought up to the reel to be unwound, by means of an actuator. A control system for reading the reel diameter keeps the belts pressed against the external surface of the reel at an adjustable pressure in relation to the diameter of said reel. Loading and unloading of the new reel and of the empty tubular core by the carriage require a separate raising system.

Patent U.S. Pat. No. 5,730,389 describes a system for connecting together the trailing end of web material unwound from a first reel and the leading end of a new reel replacing the empty reel. In this case also unwinding of the reel is performed by means of a system of belts mounted on an oscillating arm. The belts are kept up against the external surface of the reel by means of an actuator so as to exert the pressure necessary for unwinding. The reel is supported by a spindle mounted in a fixed position on a carriage performing a displacement in the axial direction of the reel.

Further systems for unwinding reels of web material by means of belts which are mounted on arms and which are brought, from above, toward the periphery of the reels are described, for example, in EP-A-0321887, GB-B793937, DE-B-445034 and U.S. Pat. No. 1,967,056. The reel is normally mounted on a fixed spindle or on an oscillating spindle, as described in U.S. Pat. No. 1,967,056, for changing the relative position of two reels.

U.S. Pat. No. 3,202,376 describes a system of unwinding belts arranged underneath the reel which is mounted on an oscillating arm associated with a cylinder/piston actuator which presses the reel against the unwinding belts which do not have any tensioning systems.

U.S. Pat. No. 3,740,296 describes a system in which a support arm transports the reel toward a belt-type unwinding system consisting of a plurality of belts driven around pulleys mounted on an oscillating arm associated with an actuator which presses the belts against the external surface of the reel. The support arm is able to oscillate so as to remove each reel to be unwound from a carriage movable in a direction parallel to the reel axis. During unwinding, the reel support arm remains in a fixed position and the movement necessary for keeping the unwinding belts up against the reel is provided by the actuator associated with the oscillating arm on which the belt drive pulleys are mounted.

U.S. Pat. No. 2,984,426 describes an unwinding system in which an oscillating arm has the function of raising the reel from the ground and bringing it up to an unwinding system comprising belts driven around fixed pulleys. The oscillating arm gradually moves during unwinding so as to keep the reel pressed against the unwinding belts during unwinding.

OBJECTS AND SUMMARY OF THE INVENTION

The object of the present invention is to provide an unwinding system which allows optimum movement of the reels from a loading station to an unwinding station and of the empty tubular cores in the opposite direction and which also allows accurate control of the unwinding process.

A further object of the present invention is to provide a device which allows automatic unloading of the tubular core of the empty reel and automatic loading of a new reel.

The object of an improved embodiment of the invention is also to provide a device which avoids an increase in the load on the reel supports, due to the pressure between unwinding members and reel, which must be added to the weight of the reel.

The object of a further improved embodiment of the invention is to eliminate the need for inserts to be applied to the ends of the tubular core of the reel so as to allow supporting thereof during unwinding.

These and further objects and advantages, which will be clear to persons skilled in the art from reading the text which follows, are essentially obtained with a device for unwinding reels of web material comprising: a carriage movable with an alternating movement in a direction of displacement between a loading and unloading position and a position for unwinding the web material from the reel; on said carriage, at least one oscillating arm, and preferably a pair of oscillating arms for each reel, for supporting at least one reel of web material, and at least one actuator for moving the oscillating arm; in the unwinding position, a flexible unwinding member driven around a plurality of pulleys, at least one of which is motorized and at least one of which is associated with a tensioning member.

The oscillating arm is controlled by the actuator so as to gradually move the spindle of a reel to be unwound toward the flexible unwinding member in relation to the reduction in diameter of the reel. The tensioning member maintains the tension on the flexible unwinding member between an approach movement and the subsequent movement of the reel support arm or arms, with take-up of the slack.

The tensioning member may advantageously consist of an air spring, ie. a cylinder/piston system, which acts on an oscillating jockey arm carrying the respective pulleys. A sensor or a microswitch or other suitable means detects the limit position of the oscillating jockey arm, beyond which the oscillating arm and the reel mounted on it must be approached so as to restore the original position of the movable pulley.

In this way, the actuator and tensioning member control the unwinding operation so that the flexible unwinding member is always correctly pressed against the external surface of the reel.

It is also possible to envisage a system which is known per se (see WO-A-9633120) for controlling the pressure of the flexible unwinding member against the reel in relation to the diameter of the latter.

In addition to this, the actuator which performs oscillation of the oscillating arm or the oscillating arms carrying the reel also has the function of raising a new reel from a loading and unloading surface into the unwinding position and of bringing back the remainder of an unwound reel (ie. basically the tubular core around which the web material was wound) onto the loading and unloading surface.

According to a practical embodiment of the invention, the carriage supports two oscillating arms, or preferably two pairs of oscillating arms, for simultaneously handling two reels. In this way, while one arm or a pair of arms keeps the working reel in an unwinding position, the other arm or pair of arms is in the loading and unloading position and unloads the empty tubular core and removes and raises a new reel which will replace the reel temporarily being unwound after being emptied. In this case the positions for loading and unloading are two, being arranged on the two sides of a single intermediate unwinding position. In the loading and unloading positions it is also envisaged to carry out the operations for preparing the free portion of the web material of the new reel for subsequent joining to the end of the web material unwound from the working reel. This operation may be performed in the background without interfering with unwinding of the working reel.

Advantageously, the or each oscillating arm may comprise a respective expandable mandrel which is inserted into the tubular core of the reel and grips it by means of radial expansion. The need to use accessory elements to be inserted into the tubular core for supporting thereof is thus avoided.

According to a preferred embodiment of the invention, the unwinding member is located underneath the axis of the reel being unwound, so that the pressure exerted by the unwinding member on the reel is not added to the weight of said reel. The load on the support arms is thus reduced.

Further characteristic advantages and embodiments of the device and the method according to the invention are described in the accompanying claims.

BRIEF DESCRIPTION OF THE DRAWINGS

The invention will be understood more clearly below with reference to the description and the accompanying drawings which illustrate a practical non-limiting embodiment of the invention. More particularly, in the drawings.

DETAILED DESCRIPTION OF THE PREFERRED EMBODIMENT

Figure 1:
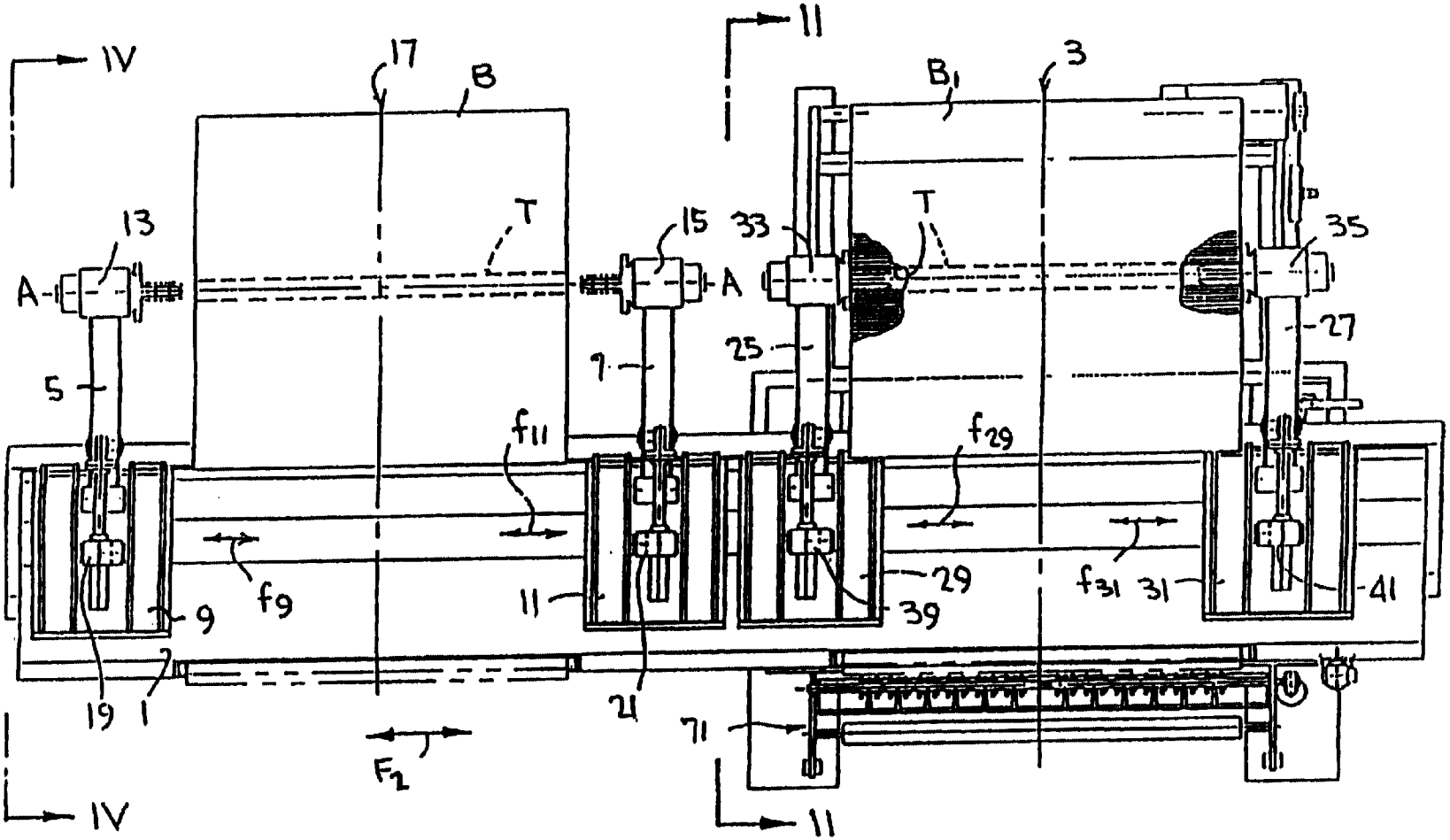
FIG. 1 shows a plan view of a device according to the invention.

Below, with initial reference to FIGS. 1 and 2, the structure of a device with a carriage supporting a dual system of oscillating arms for simultaneously handling two reels is described. It is understood that, albeit with lesser advantage, the concept underlying the present invention may also be applied to a system provided with a single system of arms for handling one reel at a time. This increases, however, the working time. Alternatively, it is possible to envisage two systems of oscillating arms which are intended to handle two reels simultaneously, but are mounted on two separate carriages, instead of on a single carriage as in the example described below.

Reference 1 denotes generally a carriage which may perform a displacement in the direction of the arrow f1 so as to bring a reel of web material to be unwound into an unwinding position indicated by 3. The carriage 1 has, arranged on it, a pair of arms 5, 7, each of which is mounted on a respective slide 9, 11. Each slide 9, 11 is able to perform a displacement in the direction of the arrows f9 and f11 so as to cause the two arms 5, 7 to move toward each other or away from each other. With this movement, a pair of mandrels 13, 15 which are hydraulically expandable and mounted on the ends of the arms 5, 7 may be inserted into the tubular winding core T of a reel B. In FIG. 1 a reel B is located in a loading and unloading position 17 situated next to the unwinding position 3.

Figure 6:
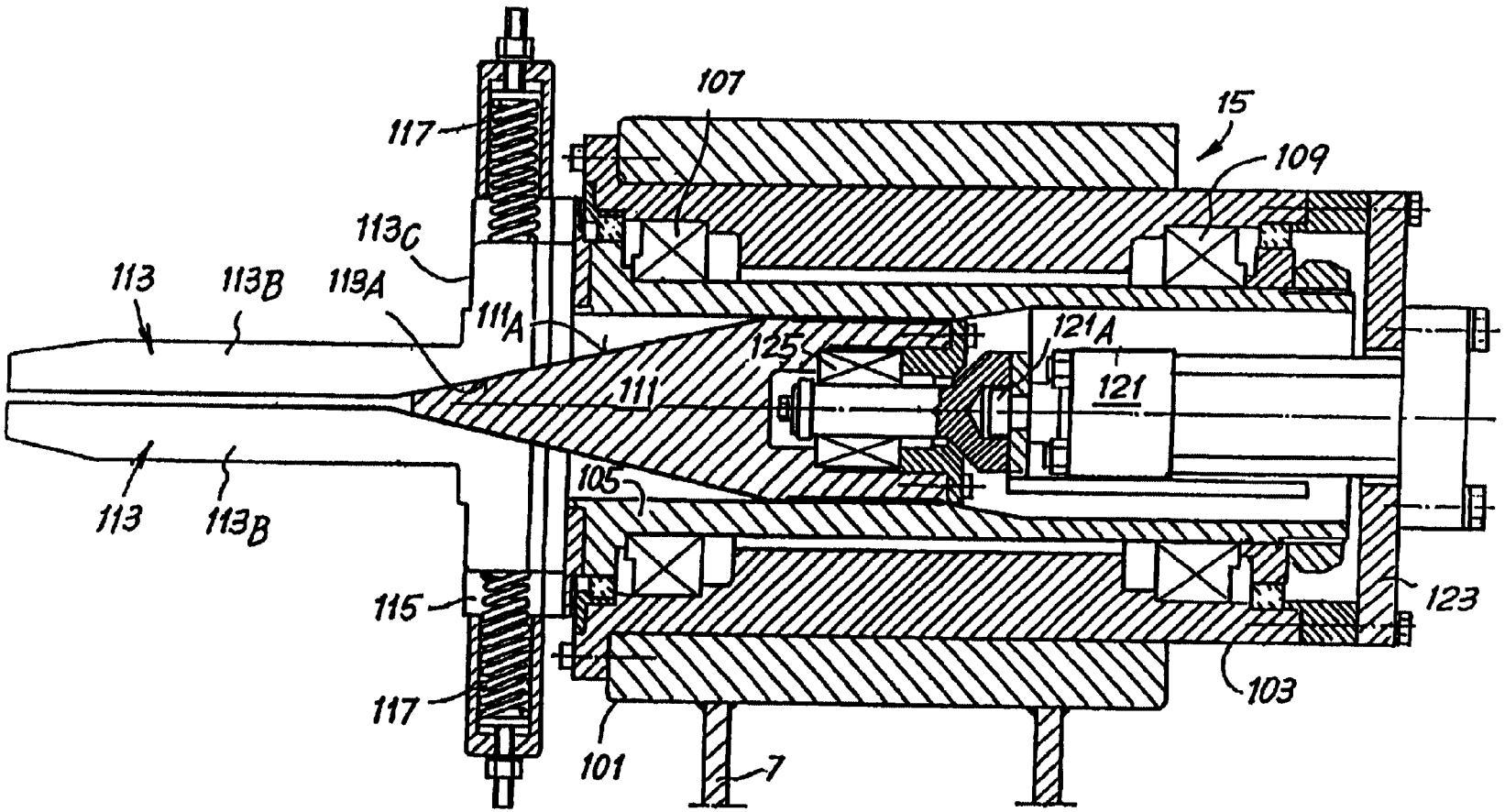
FIG. 6 shows a longitudinally sectioned view of an expandable mandrel.

FIG. 6 shows a schematic longitudinally sectioned view of the mandrel 15, the mandrel 13 being symmetrical. As shown in FIG. 6, the mandrel 15 comprises a tubular element 101 which is welded to the arm 7 and inside which a bush 103 is inserted. The latter rotatably supports a sleeve 105 by means of bearings 107, 109. The sleeve 105 houses—in an axially slidable manner with respect to the sleeve itself—a splaying member 111 which has a front portion with inclined surfaces 111A cooperating with corresponding inclined surfaces 113A of a series of cursors or linkages 113 which have nose-pieces or appendices 113B which are inserted inside the tubular core T. The cursors 113 are slidable in a radial direction with respect to the axis of the mandrel inside guides formed in a support 115 and are biased against the inclined surfaces 111A by opposition springs 117.

The splaying member 111 is displaced axially by a hydraulic cylinder/piston unit 121 supported in a fixed position with respect to the arm 7 on a plate 123 joined to the bush 103. The rod 121A of the cylinder/piston actuator 121 is connected to the splaying member 111 by means of a thrust bearing 125 so that the splaying member is able to rotate about the mandrel axis, while the cylinder/piston actuator 121 remains at a standstill.

The cylinder/piston actuator 121 causes splaying of the cursors 113 and therefore expansion of the mandrel by means of elongation of the rod 121A and consequent sliding of the splaying member 111 which pushes the cursors 113 in a radial centrifugal direction by means of the inclined surfaces 111A against the action of opposition springs 117. The mandrel is retracted by retracting the rod 121A inside the cylinder 121 and thus recalling the splaying member 111 so that the cursors 113 are displaced toward the axis under the thrusting action of the opposition springs 117. The tubular core is gripped by the mandrels along the external radial surfaces of the appendices 113B of the cursors 113. The latter also form an axial abutment 113C for the tubular core T.

Each of the two arms 5, 7 has, associated with it, an actuator 19, 21 consisting, in the example shown, of an electromechanical jack which causes an oscillating movement of the respective arm 5, 7 about an axis C—C (FIG. 2) parallel to the axis A—A of the reel B.

The carriage 1 also has, arranged on it, a second pair of arms 25, 27 which are mounted on slides 29, 31 movable in the direction of the arrows f29 and f31. The arms 25 and 27 have, mounted on their ends, mandrels 33 and 35 corresponding to the mandrels 13 and 15 associated with the arms 5 and 7. References 39 and 41 indicate two respective actuators equivalent to the actuators 19 and 21 of the first pair of arms 5 and 7. The set of arms 25, 27 with the respective mandrels 33, 35, actuators 39, 41 and slides 29, 31 is substantially identical to the set of arms 5, 7 and associated accessories. A reel B1, which is located in the unwinding position 3, is held between the mandrels 33, 35.

Unwinding of the reel B1 is obtained by means of a flexible unwinding member 45 consisting of a plurality of parallel belts (see FIG. 2) which are driven around pulleys 47, 49, 51 and 53. The belts are substantially unextendable. The pulley 49 is motor-driven by means of a motor 55 which transmits the movement to the pulley 49 by means of a transmission belt 57. The pulley 47 is mounted on an oscillating jockey arm 59 which is elastically biased by an air spring consisting of a cylinder/piston system 61. The cylinder/piston system 61 biases the jockey arm 59 so as to rotate in an anticlockwise direction, thereby keeping the flexible unwinding member 45 tensioned.

Figure 2:
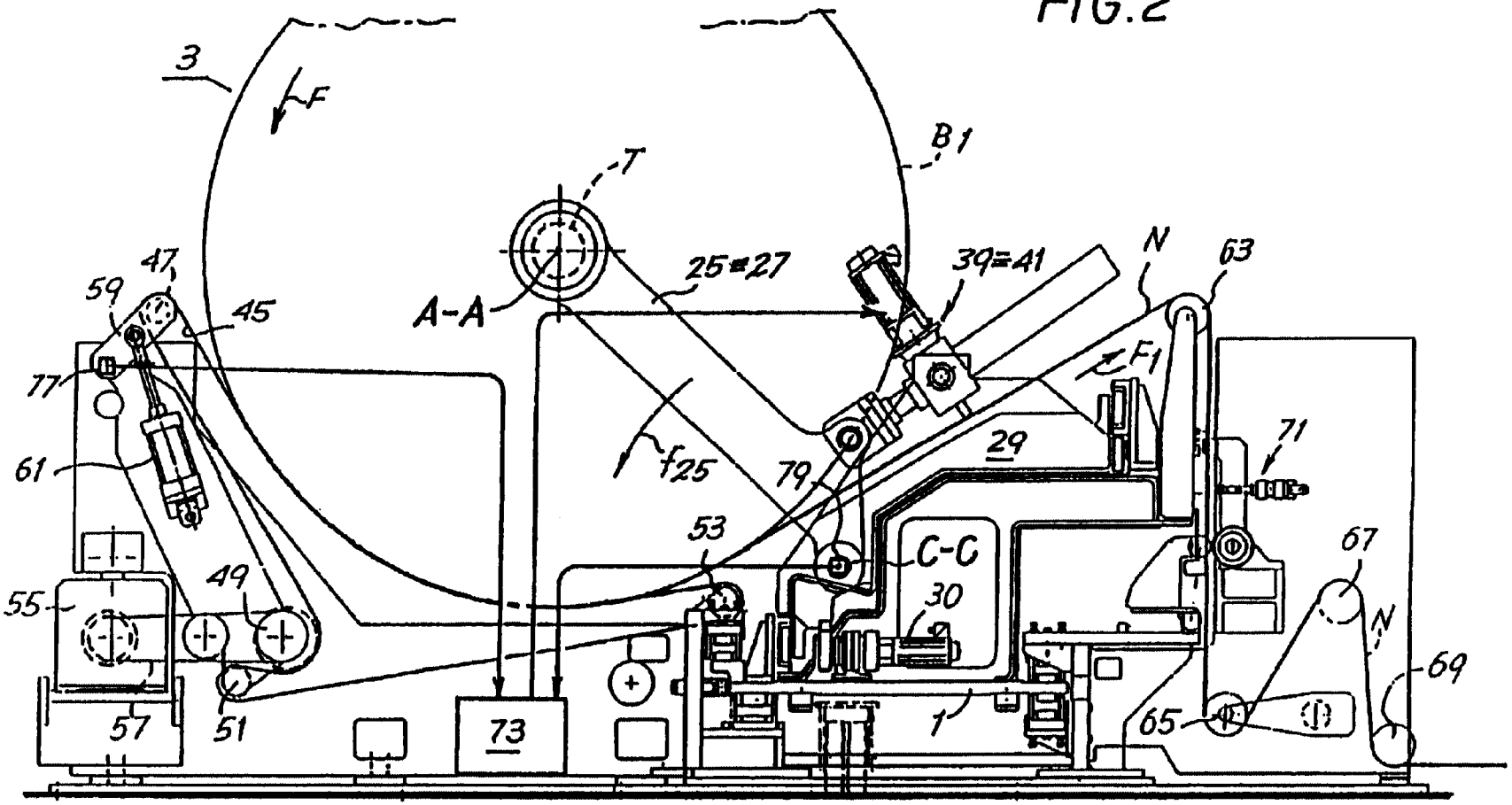
FIG. 2 shows a side view along the line II—II of FIG. 1, in a condition where the reel is full.

In FIG. 2, N denotes the web material unwound from the reel B1 and driven around rollers 63, 65, 67, 69 so as to be fed to a rewinding machine located downstream (not shown). Reference 71 denotes generally a device for joining the trailing end of the web material from a first empty reel to the leading end of the web material from a second full reel. This device is known per se and described, for example, in U.S. Pat. No. 5,730,389 to which reference may be made and which will therefore not be described in greater detail here.

In FIG. 2, 73 denotes schematically a central control unit. It is connected to a motor (not shown) which is associated with the carriage 1 and causes the translatory movement of said carriage in the direction of the arrow f1. The central unit 73 is also connected to a position sensor 77 associated with the jockey arm 59 supporting the pulley 47. Alternatively, the position sensor 77 may be associated with the rod of the cylinder/piston system 61. The sensor may consist of a magnetic sensor, a microswitch or other means suitable for detecting an end-of-travel position for the purposes described below.

The central unit 73 is also connected to an encoder or a position sensor 79 associated with the oscillating arm 25, or with the two oscillating arms 25 and 27, as well as to the actuators 39, 41 which control the oscillating movement of the arms 25 and 27. Basically, the encoder 79 may be formed by the same encoder of the electromechanical jack 39 and/or 41.

FIG. 2 also shows a motor 30 which controls the translatory movement of the slide 29. Similar motors are also envisaged for the translatory movement of the slides 31, 9 and 11.

The operating principle of the device described hitherto is as follows. In the condition shown in the FIGS. 1 and 2, the reel B1, during the initial unwinding operation, is located in the unwinding position 3 and is kept pressed against the flexible unwinding member 45 by means of the combined effect of the actuators 39, 41 and the tensioning member 61. By means of the motor 55, the flexible unwinding member 45 causes: the rotation of the reel B1 in the direction of the arrow F so as to supply the web material N in the direction of the arrow F1. During supplying, the diameter of the reel B1 gradually diminishes. The tension in the flexible unwinding member 45 is maintained owing to the elastic tensioning member 61 which biases the jockey arm 59 so as to rotate gradually in an anticlockwise direction. Since, with this movement, the tension may be recovered only to a certain degree, ie. it is only possible to compensate for a slight reduction in the diameter of the reel B1 being unwound, when the jockey arm 59 has reached a limit position detected by the position sensor 77 (or by a microswitch), the control unit 73 causes, by means of the actuators 39, 41, a lowering movement of the axis A—A of the reel B1, causing an oscillation of the arms 25, 27 in an anticlockwise direction about the axis C—C in the direction of the arrow f25. The lowering movement may have a constant and a predetermined value for each step.

Figure 3:
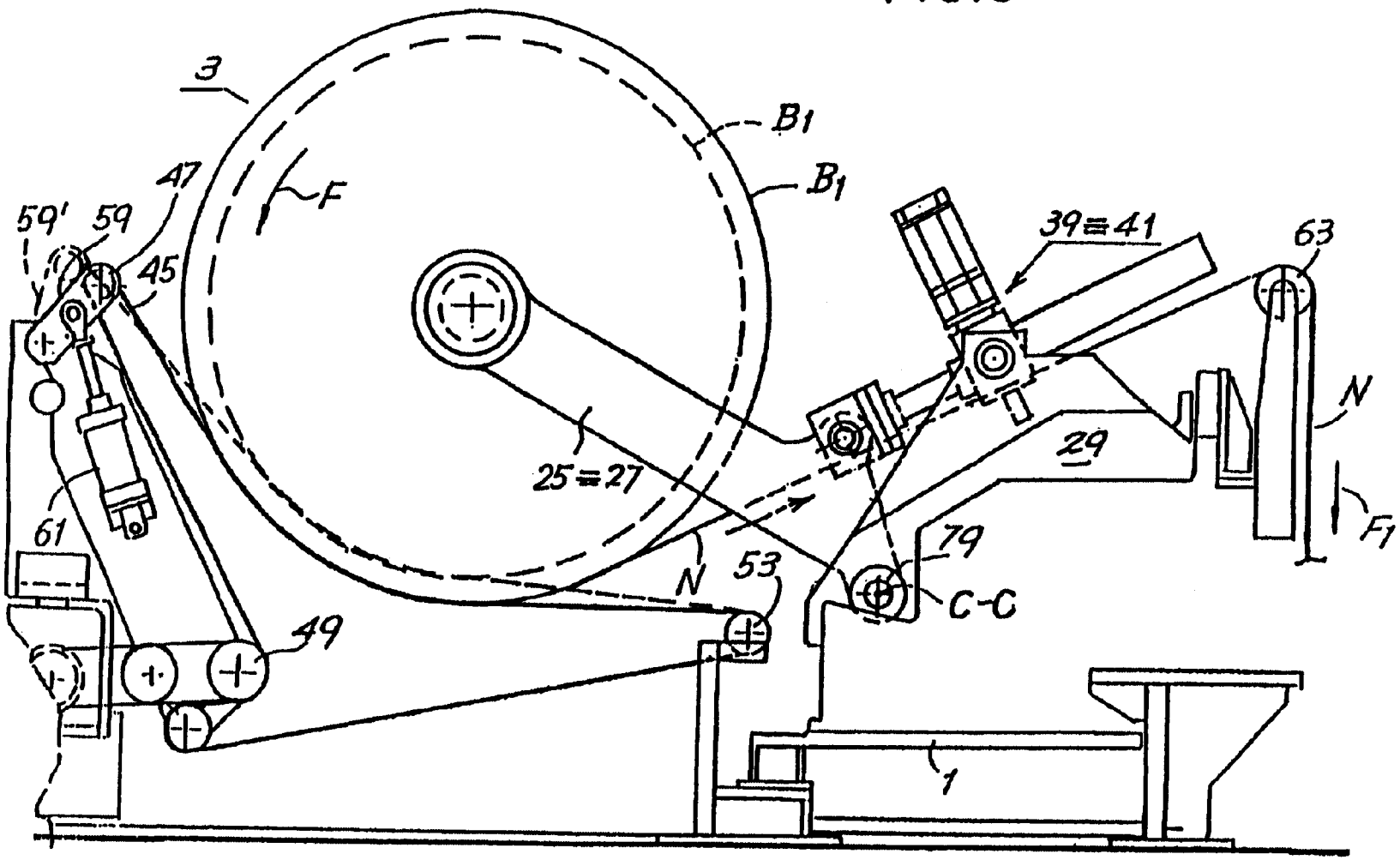
FIG. 3 shows a view similar to that of FIG. 2 during an intermediate stage of unwinding of the reel.

FIG. 3 shows an intermediate condition during unwinding of the reel B1: the oscillating arms 25, 27 have been lowered so as to compensate for a reduction in the diameter caused by the partial drawing-off of web material N. FIG. 3 also shows how, when passing from the diameter of the reel B1 shown in solid lines in said figure to the diameter of said reel shown in broken lines and indicated by B1', the pressure of the flexible unwinding member 45 is maintained (thereby compensating for the reduction in diameter) by causing oscillation, by means of the elastic tensioning member 61, of the jockey arm 59 from the position shown in solid lines to the position shown in broken lines and indicated by 59' in the same figure.

A further reduction in the diameter of the reel being unwound further causes lowering of the arms 25, 27 and consequently a return of the jockey arm 59 into the original position shown in solid lines.

The lowering movement of the arms 5, 7; 25, 27 may be controlled in the form of constant angular steps, without the need, therefore, for a position sensor or encoder able to detect at all times the angular position of said arms. In this case, the sensor 79 has solely the function of detecting the maximum raised position and maximum lowered position of the arms for loading, unloading and positioning the reel in the unwinding position. Alternatively, the sensor 79 may be replaced by a proper position encoder for supplying the control unit 73 with information regarding the angular position of the arms and therefore the diameter of the reel so as to control the unwinding system and vary the pressure between reel and unwinding member 45 in relation to the diameter. As mentioned above, the encoders associated with the motor reducers of the electromechanical jacks 39 and 41 may be used instead of an additional encoder 79.

When the reel BI being unwound in the position 3 is empty, the motor 55 is stopped and the device 71 is activated so as to commence the operations for cutting the material which has run out and then joining it to the material from a new reel. These operations are known per se and for a more detailed description reference should be made to that described, for example, in U.S. Pat. No. 5,730,389. The carriage 1 performs a translatory movement from left to right (with reference to FIG. 1) so as to bring the arms 25, 27 carrying the empty tubular core T of the reel B1 from the unwinding position 3 into a loading and unloading position symmetrical with the position 17 shown in FIG. 1 and situated on the right of the unwinding position 3. Consequently, the arms 5, 7 are brought into the unwinding position 3 so as to start a new cycle. The new reel B has been loaded beforehand and prepared with positioning of the leading portion, as described, for example, in U.S. Pat. No. 5,730,389.

The arms 25, 27 or arms 5, 7 with the associated actuators 39, 41 and 19, 21—which in the unwinding position 3 have the function of controlling the position of the reel being unwound with respect to the flexible unwinding member 45—are used in the loading and unloading position 17, i.e. in the symmetrical position on the other side of the unwinding position 3, in order to unload the tubular core of the empty reel and load a new reel.

Figure 4:
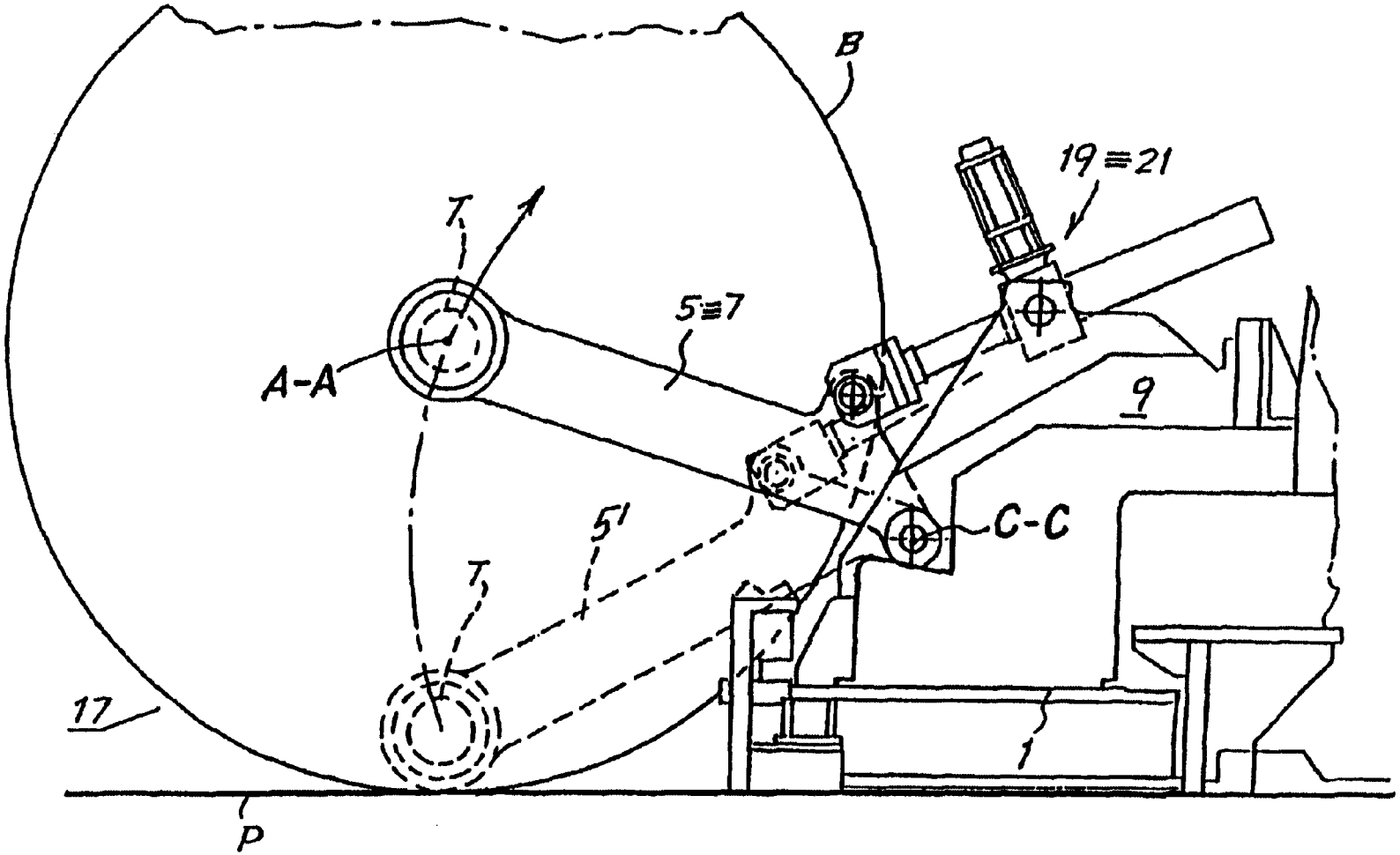
FIG. 4 shows a side view along the line IV—IV of FIG. 1, illustrating unloading of an empty core and loading of a new reel.

These operations are shown in FIG. 4 with reference to the loading and unloading position 17.

FIG. 4 shows, in broken lines and indicated by 5', the position of the oscillating arms 5, 7 for unloading an empty tubular core T supplied from the unwinding position 3. When the arms 5, 7 have reached the position shown in broken lines in FIG. 4, the mandrels 13, 15 are retracted and brought into the position shown in FIG. 1 by means of a movement of the slides 9, 11 away from each other. The empty tubular core T is thus released onto the loading and unloading surface P (which may be the ground) so as to be removed and replaced by a full reel.

FIG. 4 also shows, in solid lines, a new reel B resting on the loading and unloading surface P. The surface for unloading the empty tubular core T may also be different and at a different height from that of the loading surface for the new reel B.

After performing unloading of the tubular core T of the previously emptied reel, the arms 5, 7 are brought by the actuators 19, 21 into the position shown in solid lines in FIG. 4 so as to align the mandrels 13, 15 with the axis A—A of the reel B. By moving the arms 5, 7 toward each other relative to the position shown in FIG. 1, the mandrels enter into the tubular core T of the new reel B so as to engage the latter with the arms 5, 7 by means of pneumatic expansion of the mandrels. The arms 5, 7 are then raised by the actuators 19, 21 with an oscillating movement in a clockwise direction about the axis C—C until the reel B is brought to a height relative to the surface P such as to allow the displacement thereof into the unwinding position 3 above the unwinding member 45.

Figure 5:
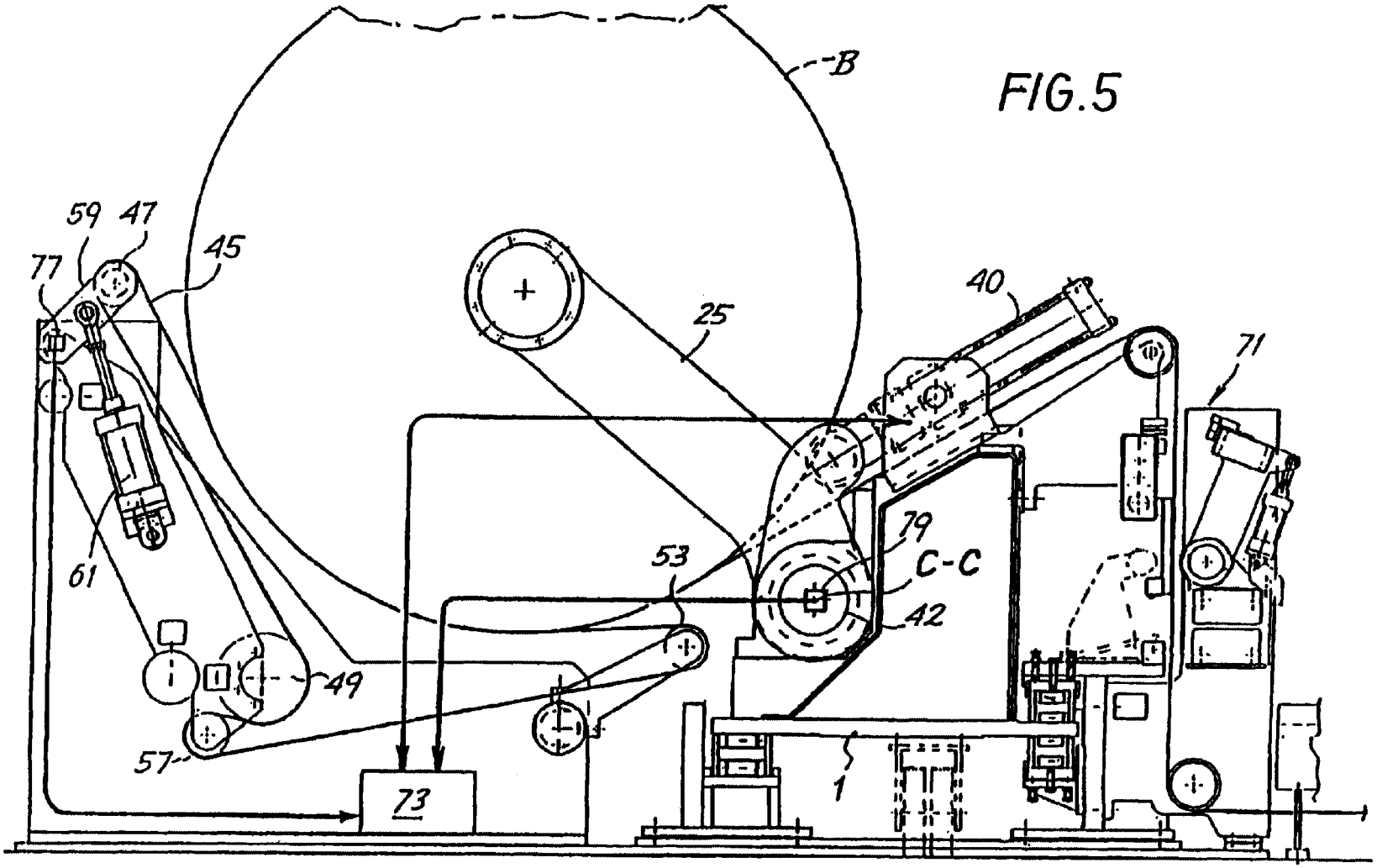
FIG. 5 shows a view, similar to that of FIG. 2, of a slightly modified embodiment of the unwinding device.

FIG. 5 shows a side view, similar to the view in FIG. 2, of a slightly modified embodiment of the device. Identical parts or parts corresponding to those shown in FIG. 2 are indicated by the same reference numbers. Essentially the difference between the embodiment according to FIG. 5 and the embodiment according to FIG. 2 consists in the fact that the actuators 39, 41 in the form of an electromechanical jack are replaced by a single cylinder/piston actuator 40 associated with one of the arms 25, 27, while a torsion bar 42 connects the two arms together so as to cause simultaneous oscillation thereof.

In this example of embodiment, the oscillating arms carrying the reel are slidable along the torsion bar 42 instead of being mounted on slides slidable along guides on the carriage 1. Longitudinal splines prevent rotation of the arms about the torsion bar. The translatory movement along the torsion bar is performed by means of hydraulic actuators or equivalent means, not shown.

On the other hand, the version shown in FIG. 2 has, compared to that shown in FIG. 5, the advantage that the two arms 5, 7; 25, 27 may be angularly offset by a predetermined amount, with the consequence that the reel supported by them is arranged with its axis inclined by any amount relative to the horizontal. This may be useful for compensating for any conicity of the reel and ensuring in this case—at least within certain limits—a uniform tension of the web material along the axial extension of the reel.

As clearly emerges from the above description, the oscillating arms 5, 7; 25, 27 are used for the dual function of controlling the position of the reel during unwinding and for handling the reels and the empty tubular cores during the loading and unloading operations. This avoids having to use special overhead cranes to perform these movements.

It is understood that the drawings show only one possible embodiment of the invention, the forms and configurations of which may vary without however departing from the idea underlying the invention.

What is claimed is:

1. A device for unwinding reels of web material wound on a core, comprising in combination:

a carriage movable in a direction of displacement between at least one loading and unloading position and an unwinding position to move a reel from said loading and unloading position to said unwinding position and, after unwinding the web material from said reel, to move said core from said unwinding position to said loading and unloading position;

on said carriage, at least one oscillating arm for supporting at least one reel of web material, and at least one actuator for moving said oscillating arm;

in the unwinding position, a flexible unwinding member driven around a plurality of pulleys, at least one of which is motorized, a member for tensioning the flexible unwinding member being associated with at least one of said pulleys;

and wherein said at least one oscillating arm is controlled by said actuator so as to move gradually the axis of a reel being unwound in said unwinding position toward the flexible unwinding member in relation to a reduction in diameter of said reel, as well as to raise the reel and to lower and release the empty core in the loading and unloading position.

2. Device according to claim 1, wherein said direction of displacement of said carriage is parallel to the axis of said reel supported by said at least one arm.

3. The device as claimed in claim 1, wherein the at least one of said pulleys with which the tensioning member is associated is mounted on an oscillating jockey arm elastically biased by said tensioning member.

4. The device as claimed in claim 2, wherein the at least one of said pulleys with which the tensioning member is associated is mounted on an oscillating jockey arm elastically biased by said tensioning member.

5. The device as claimed in claim 1, wherein said tensioning member is an air spring.

6. The device as claimed in claim 1, further comprising a control unit which, during unwinding of the reel, causes periodically a movement of said support arm toward said unwinding member when said tensioning member has reached an end-of-travel position.

7. The device as claimed in claim 2, further comprising a control unit which, during unwinding of the reel, causes periodically a movement of said support arm toward said unwinding member when said tensioning member has reached an end-of-travel position.

8. The device as claimed in claim 3, further comprising a control unit which, during unwinding of the reel, causes periodically a movement of said support arm toward said unwinding member when said tensioning member has reached an end-of-travel position.

9. The device as claimed in one of claim 1, 2, 3, 4, 5, 6, 7, or 8, wherein said carriage supports two arms or two pairs of arms for simultaneously handling two reels and wherein two loading and unloading positions are provided on two sides of the unwinding position.

10. The device as claimed in one of claim 1, 2, 3, 4, 5, 6, 7, or 8, wherein said flexible unwinding member is located underneath the axis of the reel in the unwinding position.

11. The device as claimed in one of claim 1, 2, 3, 4, 5, 6, 7, or 8, wherein said carriage supports, for each reel, a pair of oscillating arms.

12. The device as claimed in claim 11 wherein said at least one actuator causes oscillation of said pair of oscillating arms, said oscillating arms being connected together by a torsion bar.

13. The device as claimed in claim 11 wherein said pair of oscillating arms has, associated therewith, a pair of actuators, each of which causes oscillation of a respective oscillating arm of said pair.

14. The device as claimed in claim 9, wherein the arms of each pair are mounted on respective movable slides supported by said carriage, so as to move toward and away from each other.

15. The device as claimed in one of claim 1, 2, 3, 4, 5, 6, 7, or 8, wherein said oscillating arm or oscillating arms are equipped with respective expandable mandrels.

16. A method for unwinding reels of web material, comprising steps of:

a) arranging a first reel in an initial unwinding position;

b) bringing against said reel a flexible unwinding member driven by a plurality of pulleys;

c) rotating said first reel by means of said flexible unwinding member;

d) maintaining tension of said flexible unwinding member by modifying relative positions of said pulleys;

e) periodically bringing back said pulleys into the initial unwinding position by moving the axis of the reel stepwise toward the unwinding member;

f) when the first reel has run out, moving away a remainder of said first reel from said flexible unwinding member;

g) displacing said remainder of said first reel in an axial direction;

h) resting said remainder of said first reel on a loading and unloading surface;

i) picking up a second reel;

j) axially, displacing said second reel so as to bring the second reel into alignment with said flexible unwinding member;

k) repeating steps a) to j) for said second reel.

17. The method as claimed in claim 16, wherein said flexible unwinding member is brought up to the reel from under the reel.

18. The method as claimed in claim 16, or 17, wherein, while said first reel is in an unwinding position, said second reel is removed from the loading and unloading surface, subsequent axial displacement of the second reel being delayed until the first reel is empty, a loading and unloading position being provided on each side of the unwinding position.

* * * * *